US009739009B2

(12) United States Patent
Ueno et al.

(10) Patent No.: US 9,739,009 B2
(45) Date of Patent: Aug. 22, 2017

(54) SHEET-SHAPED OBJECT AND PROCESS FOR PRODUCING SAME

(71) Applicant: TORAY INDUSTRIES, INC., Tokyo (JP)

(72) Inventors: Masaru Ueno, Gifu (JP); Makoto Sumida, Otsu (JP); Yukihiro Matsuzaki, Gifu (JP)

(73) Assignee: Toray Industries, Inc., Tokyo (JP)

( * ) Notice: Subject to any disclaimer, the term of this patent is extended or adjusted under 35 U.S.C. 154(b) by 0 days.

(21) Appl. No.: 15/021,103

(22) PCT Filed: Sep. 5, 2014

(86) PCT No.: PCT/JP2014/073461
§ 371 (c)(1),
(2) Date: Mar. 10, 2016

(87) PCT Pub. No.: WO2015/037528
PCT Pub. Date: Mar. 19, 2015

(65) Prior Publication Data

US 2016/0215445 A1 Jul. 28, 2016

(30) Foreign Application Priority Data

Sep. 13, 2013 (JP) ..... 2013-190285

(51) Int. Cl.

| | |
|---|---|
| ***D06N 3/14*** | (2006.01) |
| ***D04H 1/4382*** | (2012.01) |
| ***D06C 11/00*** | (2006.01) |
| ***D06M 15/564*** | (2006.01) |

(52) U.S. Cl.
CPC ..... *D06N 3/14* (2013.01); *D04H 1/4382* (2013.01); *D06C 11/00* (2013.01); *D06M 15/564* (2013.01)

(58) Field of Classification Search
None
See application file for complete search history.

(56) References Cited

U.S. PATENT DOCUMENTS

| | | | | |
|---|---|---|---|---|
| 2011/0171890 | A1* | 7/2011 | Nakayama | B24B 37/24 451/526 |
| 2013/0005848 | A1 | 1/2013 | Koide | |
| 2013/0331014 | A1* | 12/2013 | Shiro | B24B 37/24 451/532 |

FOREIGN PATENT DOCUMENTS

| | | |
|---|---|---|
| JP | 60075681 | 4/1985 |
| JP | 05078986 | 3/1993 |
| JP | 2009013543 | 1/2009 |
| JP | 2009133053 | 6/2009 |
| JP | 2011153389 | 8/2011 |
| JP | 2011214210 | 10/2011 |
| JP | 2011231421 | 11/2011 |
| JP | 2012211414 | 11/2012 |
| JP | 2013234409 | 11/2013 |
| JP | 2014163026 | 9/2014 |
| WO | WO2012117789 A1 * | 9/2012 |

OTHER PUBLICATIONS

International Search Report for International Application No. PCT/JP2014/073461 mailed Dec. 2, 2014.
Written Opinion of the International Searching Authority for International Application No. PCT/JP2014/073461 mailed Dec. 2, 2014.

* cited by examiner

*Primary Examiner* — Tahseen N Khan
(74) *Attorney, Agent, or Firm* — RatnerPrestia

(57) ABSTRACT

A sheet-shaped object which is thin and, despite this, has a surface that is dense and is soft to the touch and which has practicable strength and a process for producing the sheet-shaped object are disclosed. This sheet-shaped object comprises ultrafine fibers having an average single-fiber diameter of 0.1-7 μm and a polymeric elastomer comprising a polyurethane as a major component, wherein when a layer extending from one surface to a depth of 50% of the thickness is referred to as layer (A) and a layer extending from the other surface to a depth of 50% of the thickness is referred to as layer (B), then the ratio of the density of fibers (A') in the layer (A) to the density of fibers (B') in the layer (B) satisfies the following expression (a) and the ratio of the density of the polymeric elastomer comprising a polyurethane as a major component (A") in the layer (A) to the density thereof (B") in the layer (B) satisfies the following expression (b). The sheet-shaped object as a whole has a density of 0.2-0.6 g/cm$^3$. $1>(A')/(B')\geq 0.5$ (a) $1>(A")/(B")\geq 0.6$ (b).

4 Claims, No Drawings

SHEET-SHAPED OBJECT AND PROCESS FOR PRODUCING SAME

CROSS REFERENCE TO RELATED APPLICATIONS

This is the U.S. National Phase application of PCT International Application No. PCT/JP2014/073461, filed Sep. 5, 2014, and claims priority to Japanese Patent Application No. 2013-190285, filed Sep. 13, 2013, the disclosures of each of these applications being incorporated herein by reference in their entireties for all purposes.

FIELD OF THE INVENTION

The present invention relates to sheet-like articles, particularly suitably to leathery sheet-like articles, and also relates to a method for production thereof.

BACKGROUND OF THE INVENTION

With good features not found in natural leather, sheet-like articles consisting mainly of ultrafine fibers and polymer elastic material have been used in various products such as clothing, chair upholstery, and automobile interior material, and they are currently acquiring new applications such as industrial materials as well as outer covering and cases of mobile devices, resulting in demands increasing year after year. Under such circumstances, thinner sheets are now called for to meet diversifying needs and demands are also increasing for high-strength products that meet practical uses. Various proposals have been made aiming to meet these requirements.

Specifically, a study has proposed a method in which a sheet-like article that can serve as industrial material with high strength and pilling resistance can be produced from a suede-like leather sheet composed mainly of ultrafine fibers and an elastic polymer in which the elastic polymer is localized near the surfaces in the thickness direction of nonwoven fabric (see Patent document 1). This proposal is intended to achieve high strength and pilling resistance of the surface by localizing an elastic polymer near the surface region, but as a result of the elastic polymer being localized near the surface region, the fibers are held strongly by the elastic polymer, easily leading to problems such as insufficient napping, short raised fibers, and unsmooth surface quality with rough feel. In this proposal, furthermore, the amount of squeezed liquid resulting from impregnation with a solution or aqueous dispersion of an elastic polymer is adjusted properly and the movement of the elastic polymer toward the surface is controlled during coagulation and during drying in order to localize the elastic polymer near the surface region. In the case of a thin sheet, however, the movement distance is so short in the thickness direction that it will be difficult to perform control as proposed above and accordingly it will be difficult to obtain a high-strength sheet-like article.

Another document proposes an artificial leather produced by inserting high-strength woven fabric into nonwoven fabric that constitutes a sheet-like article, thereby forming a structure in which the quotient of the height of the overlapping portion of the cross section between adjacent yarns in the inserted high-strength woven fabric by the diameter of the yarns of the high-strength woven fabric is 0.25 or less (see Patent document 2). This proposal is intended to increase the strength of artificial leather by inserting high-strength woven fabric, but the proposed woven fabric itself has a significant thickness, making it difficult to provide a thin product.

As stated above, no attempts have ever succeeded in providing a leathery sheet-like article that is thin as well as high in quality and strength.

PATENT DOCUMENTS

Patent document 1: Japanese Unexamined Patent Publication (Kokai) No. 2012-211414

Patent document 2: Japanese Unexamined Patent Publication (Kokai) No. 2011-153389

SUMMARY OF THE INVENTION

An object of the present invention is to provide a sheet-like article that has a dense, soft-to-the-touch surface though being thin and also has such a high strength as to meet practical requirements.

The sheet-like article according to embodiments of the present invention is a sheet-like article comprising ultrafine fibers with an average monofilament diameter of 0.1 μm or more and 7 μm or less and an elastic polymer containing polyurethane as primary component, meeting Formula (a) given below for the ratio between the fiber density (A') in the layer having a thickness equal to 50% of the total thickness measured from one of the surfaces, hereinafter referred to as layer (A), and the fiber density (B') in the layer having a thickness equal to 50% of the total thickness measured from the other surface, hereinafter referred to as layer (B), meeting Formula (b) given below for the ratio between the density (A") of the elastic polymer containing polyurethane as primary component in layer (A) and that (B") in layer (B), and having an overall density of 0.20 g/cm$^3$ or more and 0.60 g/cm$^3$ or less for the entire sheet-like article:

$$1>(A')/(B')\geq 0.5 \quad \text{(a)}$$

$$1>(A'')/(B'')\geq 0.6 \quad \text{(b).}$$

According to a preferred embodiment of the sheet-like article of the present invention, one of the surfaces contains raised ultrafine fibers while the other surface comprises ultrafine fibers and an elastic polymer containing polyurethane as primary component, with the ultrafine fibers being held by the elastic polymer.

According to a preferred embodiment of the sheet-like article of the present invention, the thickness of the sheet-like article is 0.2 mm or more and 0.8 mm or less.

In the production method for the sheet-like article according to the present invention, a sheet-like article comprising ultrafine fibers with an average monofilament diameter of 0.1 μm or more and 7 μm or less and an elastic polymer containing polyurethane as primary component is produced by carrying out the following steps of (i) to (vi) in this order:

(i) a step for preparing nonwoven fabric by entangling ultrafine fiber-generating fibers comprising two or more types of thermoplastic resin that differ in solubility to a solvent, (ii) a step for impregnating the nonwoven fabric with an aqueous solution of water-soluble resin and drying it at 110° C. or more to combine it with the water-soluble resin, (iii) a step for pressing the nonwoven fabric combined with water-soluble resin to provide a sheet, (iv) a step for combining the sheet resulting from step (iii) above with an elastic polymer containing polyurethane as primary component by performing treatment thereof with a solvent to develop ultrafine fibers with an average monofilament diameter of 0.1 μm or more and 7 μm or less and impregnating the sheet with a solution of an elastic polymer containing polyurethane as primary component, followed by solidification, or impregnating the sheet resulting from step (iii) above with a solution of an elastic polymer containing polyurethane as primary component, followed by solidification, to combine the sheet with the elastic polymer containing polyurethane as primary component, and then treating the sheet with a solvent to develop ultrafine fibers with an average monofilament diameter of 0.1 μm or more and 7 μm or less, (v) cutting the sheet resulting from step (iv) above in half in the thickness direction, and (vi) napping only the non-cut surface of each half of the sheet resulting from step (v) above.

The present invention can provide a sheet-like article that has a dense, soft-to-the-touch surface though being thin and also has such a high strength as to meet practical requirements.

DETAILED DESCRIPTION OF EMBODIMENTS OF THE INVENTION

The sheet-like article according to embodiments of the present invention is a sheet-like article comprising ultrafine fibers with an average monofilament diameter of 0.1 μm or more and 7 μm or less and an elastic polymer containing polyurethane as primary component, meeting Formula (a) given below for the ratio between the fiber density (A') in the layer having a thickness equal to 50% of the total thickness measured from one of the surfaces, hereinafter referred to as layer (A), and the fiber density (B') in the layer having a thickness equal to 50% of the total thickness measured from the other surface, hereinafter referred to as layer (B), meeting Formula (b) given below for the ratio between the density (A") of the elastic polymer containing polyurethane as primary component in layer (A) and that (B") in layer (B), and having an overall density of 0.20 g/cm$^3$ or more and 0.60 g/cm$^3$ or less for the entire sheet-like article:

$$1>(A')/(B')\geq 0.5 \quad \text{(a)}$$

$$1>(A'')/(B'')\geq 0.6 \quad \text{(b).}$$

As described above, the sheet-like article according to embodiments of the present invention contains ultrafine fibers and these ultrafine fibers serve to develop suede-like or nubuck-like elegant appearance and texture.

Such ultrafine fibers used to form the sheet-like article according to the present invention may be of such materials as polyesters including polyethylene terephthalate, polybutylene terephthalate, polytrimethylene terephthalate, polyethylene-2,6-naphthalene dicarboxylate, and polylactic acid; polyamides including 6-nylon and 66-nylon; and other various synthetic fiber materials including acrylic, polyethylene, polypropylene, and thermoplastic cellulose. Among others, polyester fibers such as polyethylene terephthalate, polybutylene terephthalate, and polytrimethylene terephthalate are particularly preferred from the viewpoint of high strength, dimensional stability, light resistance, and dyeing properties. From the viewpoint of environment protection, it may be advisable to use fibers derived from recycled material or plant-derived material. Furthermore, they may contain ultrafine fibers of different materials.

It is also preferred that the polymer used as material of such ultrafine fibers contain inorganic particles such as titanium oxide particles and additives such as lubricant, pigment, thermal stabilizer, ultraviolet absorber, electrically conductive agent, heat storage agent, and antibacterial agent to meet various purposes.

It is important for the ultrafine fibers in the sheet-like article according to an embodiment of the present invention to have an average monofilament diameter of 0.1 to 7 μm. Controlling the average monofilament diameter at 7 μm or less, preferably 5 μm or less, more preferably 4 μm or less, serves to obtain a sheet-like article having highly flexible, dense, soft-to-the-touch surface quality.

On the other hand, controlling the average monofilament diameter at 0.1 μm or more, preferably 0.7 μm or more, more preferably 1 μm or more, ensures high post-dyeing color development performance, high fiber dispersibility during napping treatment by grinding with sandpaper or the like, and easy untangling.

As for the cross-sectional shape of ultrafine fibers, a circular cross section is suitable though fibers having cross sections of other shapes such as an ellipse, flat shape, polygon like triangle, sector, or cross may also be adopted.

The sheet-like article of ultrafine fibers is preferably in the form of nonwoven fabric (occasionally referred to as ultrafine fiber web). Such nonwoven fabric can have a uniform, elegant appearance and texture.

The non-woven fabric may be either short-fiber non-woven fabric or long-fiber non-woven fabric, but short-fiber non-woven fabric is preferred when importance is placed on texture and quality.

If short-fiber non-woven fabric is to be used, the ultrafine fibers used preferably have a fiber length of 25 mm to 90 mm. Controlling the fiber length at 90 mm or less ensures high quality and good texture while controlling the fiber length at 25 mm or more serves to obtain a sheet-like article with high wear resistance. The fiber length is more preferably 35 to 80 mm and particularly preferably 40 to 70 mm.

The sheet-like article according to an embodiment of the present invention also comprises an elastic polymer containing polyurethane as primary component. An elastic polymer is a stretchable polymeric compound having rubber elasticity and major elastic polymers include polyurethane, SBR, NBR, and acrylic resin. Here, the term "primary component" used herein means that the polyurethane component accounts for more than 50 mass % of the total mass of the elastic polymer.

The use of an elastic polymer containing polyurethane as primary component serves to produce a sheet-like article having solid feel to the touch, leathery appearance, and practically durable physical properties.

There are various types of polyurethane including organic solvent-soluble ones that are used in a state of being dissolved in an organic solvent and water-dispersed ones that are used in a state of being dispersed in water, both of which can work for the present invention.

Polyurethane obtained by reaction of a polymer diol, an organic diisocyanate, and a chain extending agent is preferred as a polyurethane component to be used for the present invention.

For example, a polycarbonate-based, polyester-based, polyether-based, silicone-based, or fluorine-based diol can be used as the aforementioned polymer diol, and a copolymer of a combination of these diols can also be used. The use of a polyether-based diol is preferred from the viewpoint of texture. Furthermore, the use of a polycarbonate-based or polyether-based diol is preferred from the viewpoint of hydrolysis resistance and the use of a polycarbonate-based or polyester-based one is preferred from the viewpoint of light resistance and heat resistance. Furthermore, the use of a polycarbonate-based or polyester-based diol is more preferred from the viewpoint of the balance among hydrolysis resistance, heat resistance, and light resistance, and the use of a polycarbonate-based diol is particularly preferred among others.

A polycarbonate-based diol as described above can be produced, for example, through ester exchange reaction between alkylene glycol and ester carbonate or through reaction of phosgene or a chloroformate with alkylene glycol.

For example, useful alkylene glycols as described above include linear alkylene glycols such as ethylene glycol, propylene glycol, 1,4-butane diol, 1,5-pentane diol, 1,6-hexane diol, 1,9-nonane diol, and 1,10-decane diol; branched alkylene glycols such as neopentyl glycol, 3-methyl-1,5-pentane diol, 2,4-diethyl-1,5-pentane diol, and 2-methyl-1,8-octane diol; alicyclic diols such as 1,4-cyclohexane diol; aromatic diols such as bisphenol A; and others such as glycerin, trimethylol propane, and pentaerythritol. For the present invention, each of these diols may be either a polycarbonate-based diol which is produced from a single alkylene glycol or a copolymerized polycarbonate-based diol which is produced from two or more types of alkylene glycols.

Examples of the polyester-based diols include polyester diols produced by condensing one of various low molecular weight polyols and a polybasic acid.

For example, one or a plurality selected from the following can be used as the low molecular weight polyol described above: ethylene glycol, 1,2-propylene glycol, 1,3-propylene glycol, 1,3-butane diol, 1,4-butane diol, 2,2-dimethyl-1,3-propane diol, 1,6-hexane diol, 3-methyl-1,5-pentane diol, 1,8-octane diol, diethylene glycol, triethylene glycol, dipropylene glycol, tripropylene glycol, cyclohexane-1,4-diol, and cyclohexane-1,4-dimethanol. Furthermore, an adduct which is formed by adding one of various alkylene oxides to bisphenol A is also usable.

Furthermore, for example, one or a plurality selected from the following can be used as the polybasic acid described above: succinic acid, maleic acid, adipic acid, glutaric acid, pimelic acid, suberic acid, azelaic acid, sebacic acid, dodecane dicarboxylic acid, phthalic acid, isophthalic acid, terephthalic acid, and hexahydroisophthalic acid.

Examples of the aforementioned polyether-based diols include polyethylene glycol, polypropylene glycol, polytetramethylene glycol, and copolymerized diols which are formed by combining these substances.

A polymer diol to be used for the present invention preferably has a number average molecular weight of 500 to 4,000. A number average molecular weight should preferably be 500 or more, more preferably 1,500 or more, to prevent the resulting sheet-like article from having stiff texture. Furthermore, a number average molecular weight of preferably 4,000 or less, more preferably to 3,000 or less, allows the polyurethane to maintain a required inherent strength.

For example, usable organic diisocyanates as described above include aliphatic diisocyanates such as hexamethylene diisocyanate, dicyclohexylmethane diisocyanate, isophorone diisocyanate, and xylylene diisocyanate; and aromatic diisocyanates such as diphenylmethane diisocyanate and tolylene diisocyanate, which may be used in combination. In particular, the use of aromatic diisocyanates such as diphenylmethane diisocyanate is preferred when durability and heat resistance are important, while the use of aliphatic diisocyanates such as hexamethylene diisocyanate, dicyclohexylmethane diisocyanate, and isophorone diisocyanate is preferred when light resistance is important.

Useful chain extending agents include, for example, amine-based chain extending agents such as ethylene diamine and methylene bisaniline, and diol-based chain extending agents such as ethylene glycol. Furthermore, a polyamine which is obtained by reacting polyisocyanate and water can also be used as chain extending agent.

A crosslinking agent may be used in combination with polyurethane with the aim of improving waterproofness, wear resistance, hydrolysis resistance, etc., as required. The crosslinking agent may be either an external crosslinking agent to be added to polyurethane as a third component or an internal crosslinking agent that contains a reaction point acting as a crosslinking structure in the polyurethane molecular structure. For the present invention, it is preferable to use an internal crosslinking agent because crosslinking points can be formed uniformly in the polyurethane molecular structure, thereby mitigating the reduction in flexibility.

A compound containing an isocyanate group, an oxazoline group, a carbodiimide group, an epoxy group, a melamine resin, or a silanol group can be used as the aforementioned crosslinking agent. However, as crosslinking progresses excessively, polyurethane tends to harden, resulting in a sheet-like article with stiff texture. Therefore, the use of a crosslinking agent containing a silanol group is preferred from the viewpoint of the balance between reactivity and flexibility.

If a water-dispersed polyurethane is used for the present invention, it is preferable to adopt an internal emulsifier to allow the polyurethane to be dispersed in water. Examples of the internal emulsifier include cationic ones such as quaternary amine salt; anionic ones such as sulfonate and carboxylate; nonionic ones such as polyethylene glycol; combinations of cationic and nonionic ones; and combinations of anionic and nonionic ones. In particular, nonionic internal emulsifiers are preferred because they are higher in light resistance than cationic internal emulsifiers and free of problems attributed to neutralization agents as compared to anionic internal emulsifiers.

Any elastic polymer used for the present invention may contain elastomer resins, such as polyester-based, polyamide-based, and polyolefin-based ones, acrylic resins, and ethylene-vinyl acetate resins unless they impair the texture or performance thereof as binder. Furthermore, the elastic polymer may contain various additives including pigments such as carbon black; flame retarders such as phosphorus-based, halogen-based, and inorganic ones; antioxidants such as phenol-based, sulfur-based, and phosphorus-based ones; ultraviolet light absorbers such as benzotriazole-based, benzophenone-based, salicylate-based, cyanoacrylate-based, and oxalic acid anilide-based ones; light stabilizers such as hindered amine-based and benzoate-based ones; hydrolysis-resistant stabilizers such as polycarbodiimide; and others such as plasticizers, antistatic agents, surfactants, solidification-adjusting materials, and dyes.

The content of the elastic polymer can be adjusted appropriately considering the type of the polyurethane used and the polyurethane production method described later as well as texture and physical properties. The content of the elastic polymer is preferably 10 wt % or more and 100 wt % or less, more preferably 20 wt % or more and 50 wt % or less.

It is also preferable for the sheet-like article according to the present invention to contain, for example, dyes, pigments, softening agent, texture adjustor, pilling prevention agent, antibacterial agent, deodorant, water repellent agent, light resisting agent, and weathering agent.

It is important for the sheet-like article according to an embodiment of the present invention to be a sheet-like article that meets Formula (a) given below for the ratio between the fiber density (A') in the layer having a thickness equal to 50% of the total thickness measured from one of the surfaces, i.e. layer (A), and the fiber density (B') in the layer having a thickness equal to 50% of the total thickness measured from the other surface, i.e. layer (B), and meets Formula (b) given below for the ratio between the density (A") of the elastic polymer containing polyurethane as primary component in layer (A) and that (B") in layer (B):

$$1>(A')/(B')\geq 0.5 \quad \text{(a)}$$

$$1>(A'')/(B'')\geq 0.6 \quad \text{(b).}$$

That is to say, it is important that the fiber density and the density of the elastic polymer containing polyurethane as primary component be smaller near either of the surfaces (occasionally referred to as product-side surface) while the fiber density and the density of the elastic polymer containing polyurethane as primary component be larger near the other surface (reverse surface).

If the fiber density and the density of the elastic polymer containing polyurethane as primary component is smaller near either of the surfaces as shown in Formula (a), the surface will be raised easily and have dense, soft-to-the-touch surface quality. Specifically, controlling the fiber density ratio preferably at less than 1, preferably 0.95 or less, more preferably at 0.9 or less, will serve to produce a surface that can be napped easily and has a dense, soft-to-the-touch quality though being thin, and a practically high abrasion resistance can be achieved as the fiber density ratio is increased to 0.5 or more, preferably 0.6 or more, more preferably 0.65 or more.

On the other hand, the strength of the sheet-like article itself increases with an increasing fiber density and an increasing density of the elastic polymer containing polyurethane as primary component near the other surface. Specifically, controlling the density ratio between layer (A) of the elastic polymer and layer (B) at less than 1, preferably 0.95 or less, more preferably at 0.9, will serve to produce a surface that can be napped easily and has a dense, soft-to-the-touch quality and serves to reduce the defective effect of the elastic polymer containing polyurethane as primary component exposed at the product-side surface. Furthermore, a practically high abrasion resistance can be achieved as the density ratio between layer (A) of the elastic polymer and layer (B) is increased to 0.6 or more, preferably 0.7 or more, more preferably 0.75 or more. The formation of this structure serves to simultaneously achieve both a dense, soft-to-the-touch surface quality in spite of being thin and practically good physical properties.

It is important for the sheet-like article according to an embodiment of the present invention to have an overall density of 0.20 g/cm$^3$ or more and 0.60 g/cm$^3$ or less over the entire sheet-like article. Controlling the density at 0.20 g/cm$^3$ or more allows the sheet-like article itself to have practically good physical properties while controlling the density at 0.60 g/cm$^3$ or less allows the sheet-like article to have a good texture. The overall density of the entire sheet-like article is preferably 0.22 g/cm$^3$ or more and 0.50 g/cm$^3$ or less, more preferably 0.25 g/cm$^3$ or more and 0.40 g/cm$^3$ or less.

As the sheet-like article becomes thinner, the metsuke (weight per unit surface area) of the fiber in the sheet-like article and that of the elastic polymer containing polyurethane as primary component decrease and the strength of the sheet-like article deteriorates. Accordingly, the sheet-like article according to the present invention, which can simultaneously achieve both a dense, soft-to-the-touch surface quality in spite of being thin and practically good physical properties, can show the above effect more easily as its thickness decreases. To show the effect, the sheet-like article according to the present invention preferably has a thickness of 0.2 mm or more and 0.8 mm or less, more preferably 0.2 mm or more and 0.65 mm or less.

It is preferable for the sheet-like article according to the present invention, furthermore, that either of the surfaces of the sheet-like article have a raised nap of ultrafine fibers while the other surface comprise ultrafine fibers and an elastic polymer containing polyurethane as primary component, with the ultrafine fibers being held by the elastic polymer containing polyurethane as primary component. In such a state in which ultrafine fibers are held by an elastic polymer containing polyurethane as primary component, the ultrafine fibers and the elastic polymer are adhered to each other.

Thus, a napped surface on either side allows the sheet-like article to have good suede-like quality while if the surface on the other side is unnapped and contains ultrafine fibers and an elastic polymer containing polyurethane as primary component, with the ultrafine fibers being held by the elastic polymer, this surface allows the sheet-like article itself to maintain a practically high strength. If the surface on the other side contains ultrafine fibers and an elastic polymer containing polyurethane as primary component, with the ultrafine fibers being held by the elastic polymer, furthermore, the ultrafine fibers on this surface are fixed by the elastic polymer and thickness restoration due to raising of the nap will not occur on this surface during dyeing, making it possible to obtain a thinner sheet-like article (product).

Next, the method for producing the sheet-like article according to embodiments of the present invention is explained below.

In the production method for the sheet-like article according to an embodiment of the present invention, a sheet-like article comprising ultrafine fibers with an average monofilament diameter of 0.1 μm or more and 7 μm or less and an elastic polymer containing polyurethane as primary component is produced by carrying out the following steps of (i) to (vi) in this order:

(i) a step for preparing nonwoven fabric by entangling ultrafine fiber-generating fibers comprising two or more types of thermoplastic resin that differ in solubility to a solvent, (ii) a step for impregnating the nonwoven fabric with an aqueous solution of water-soluble resin and drying it at 110° C. or more to combine it with the water-soluble resin, (iii) a step for pressing the nonwoven fabric combined with water-soluble resin to provide a sheet, (iv) a step for combining the sheet resulting from step (iii) above with an elastic polymer containing polyurethane as primary component by performing treatment thereof with a solvent to develop ultrafine fibers with an average monofilament diameter of 0.1 μm or more and 7 μm or less and impregnating the sheet with a solution of an elastic polymer containing polyurethane as primary component, followed by solidification, or impregnating the sheet resulting from step (iii) above with a solution of an elastic polymer containing polyurethane as primary component, followed by solidification, to combine the sheet with the elastic polymer containing polyurethane as primary component, and then treating the sheet with a solvent to develop ultrafine fibers with an average monofilament diameter of 0.1 μm or more and 7 μm or less, (v) cutting the sheet resulting from step (iv) above in half in the thickness direction, and (vi) napping only the non-cut surface of each half of the sheet resulting from step (v) above. Carrying out steps (i) to (vi) in this order provides a sheet-like article that has a dense, soft-to-the-touch surface though being thin and also has such a high strength as to meet practical requirements.

First, step (i) is described below.

Step (i) is designed to prepare nonwoven fabric by entangling two or more types of ultrafine fiber-generating fibers of thermoplastic resin that differ in solubility to a solvent.

First, ultrafine fiber-generating fibers are entangled to form nonwoven fabric and the fibers are treated to make them ultrafine in step (iv) which is performed subsequently, thereby providing nonwoven fabric of entangled ultrafine fibers.

Adoptable ultrafine fiber-generating fibers include: island-in-sea type composite ones produced by using two thermoplastic resins different in solubility in a solvent as sea component and island component and dissolving and removing the sea component by using a solvent or the like to allow the island component to be left to form ultrafine fibers; and splittable type composite ones produced by alternately disposing two thermoplastic resins so that their cross sections are arranged radially or in layers and then splitting and separating the two components to form ultrafine fibers. In particular, island-in-sea type composite fibers are preferred from the viewpoint of texture and surface quality because the removal of the sea regions will leave moderate gaps among island regions, i.e., among ultrafine fibers in each fiber bundle.

Island-in-sea type composite fibers can be produced by using an island-in-sea type composite spinneret through which two mutually aligned components, i.e., sea and island, are spun in a mutually aligned polymer array or by spinning a mixture of two components, i.e., sea and island, by the blend spinning technique, of which the use of the mutually aligned polymer array spinning method is preferred for the production of island-in-sea type composite fibers because ultrafine fibers with uniform fineness can be obtained.

If short fiber nonwoven fabric is used as the aforementioned nonwoven fabric, it is preferable for the resulting ultrafine fiber-generating fibers to be crimped and then cut to required length to provide raw stock. Generally known methods may be used for the crimping and cutting steps.

Then, the resulting raw stock is processed by, for example, a cross lapper to produce a fiber web, which is then subjected to fiber entangling treatment to provide nonwoven fabric. Useful methods for producing nonwoven fabric by entangling fibers in a web include needle punching and water jet punching.

It is also preferable for the aforementioned nonwoven fabric to be subjected to heat shrinkage treatment with warm water or steam to improve the dense feeling of the fibers.

Next, step (ii) is described below.

Step (ii) is designed to impregnate the nonwoven fabric with an aqueous solution of water-soluble resin and dry it at 110° C. or more to combine it with the water-soluble resin. This causes migration of the water-soluble resin through the nonwoven fabric so that the resin will be localized near the surfaces of the nonwoven fabric. Combining the nonwoven fabric with water-soluble resin allows the fibers to be fixed to ensure improved dimensional stability, and the localization of the water-soluble resin near the surfaces of the nonwoven fabric allows the inner parts, where the water-soluble resin content is small and dimensional stability is low, to be pressed preferentially in the subsequent step (iii) for compression in the thickness direction, leading to the formation of a structure having lower fiber densities near the surfaces and higher fiber densities in the inner parts. In the subsequent step (iv) where an elastic polymer containing polyurethane as primary component is injected after developing ultrafine fibers, furthermore, the localization of the water-soluble resin near the surfaces leads to a smaller content of the elastic polymer containing polyurethane as primary component near the surfaces where the content of the water-soluble resin is large and also leads to a smaller contact area between the ultrafine fibers and the elastic polymer containing polyurethane as primary component because their contact is hindered by the water-soluble resin. In the inner parts of the nonwoven fabric where the content of the water-soluble resin is smaller, it is possible to inject a larger amount of the elastic polymer containing polyurethane as primary component, leading to a larger contact area between the ultrafine fibers and the elastic polymer containing polyurethane.

In the fiber sheet thus produced, both the fiber density and the density of the elastic polymer containing polyurethane as primary component are low and their contact area is small near the surfaces and accordingly, the surfaces can be napped easily, allowing the production of products with dense, soft-to-the-touch surfaces. In the inner parts, on the other hand, both the fiber density and the density of the elastic polymer containing polyurethane as primary component are high and their contact area is large, leading to a higher strength. The fiber sheet thus obtained is cut in half in the thickness direction in step (v) and the surface opposite to the cut surface is napped in step (vi) so that an inner plane (high-strength plane) that is abundant in both ultrafine fibers and the elastic polymer containing polyurethane as primary component constitutes the reverse surface. Accordingly the sheet meets the essential requirements represented by Formula (a) given below for the ratio between the fiber density (A') in the layer having a thickness equal to 50% of the total thickness measured from one of the surfaces, i.e. layer (A), and the fiber density (B') in the layer having a thickness equal to 50% of the total thickness measured from the other surface, i.e. layer (B), $$1>(A')/(B')\geq 0.5 \quad \text{(a)}$$

and by Formula (b) given below for the ratio between the density (A") of the elastic polymer containing polyurethane as primary component in layer (A) and that (B") in layer (B), $$1>(A'')/(B'')\geq 0.6 \quad \text{(b).}$$

For the present invention, polyvinyl alcohol with a degree of saponification of 80% or more is preferred as the water-soluble resin.

Useful methods for combining nonwoven fabric with water-soluble resin include impregnating nonwoven fabric with an aqueous solution of water-soluble resin, followed by drying. The concentration of the aqueous solution of water-soluble resin is preferably 1% or more and 20% or less. It is important for the drying temperature to be 110° C. or more to ensure efficient migration.

The water-soluble resin preferably accounts for 10 to 60 mass % relative to the mass of the nonwoven fabric (sheet) measured immediately before impregnation. The aforementioned structure can be obtained when the impregnation quantity is 10 mass % or more. Controlling the impregnation quantity at 60 mass % or less allows the production of a sheet (or sheet-like article) with high processability and good physical properties including wear resistance.

The water-soluble resin in the nonwoven fabric is removed using hot water or the like after injecting an elastic polymer containing polyurethane as primary component in step (iv).

Next, step (iii) is described below.

Step (iii) is designed to press the nonwoven fabric combined with water-soluble resin to provide a sheet. As described above, it is important that the nonwoven fabric formed of ultrafine fibers and containing water-soluble resin, spread by migration, be pressed in the thickness direction. As a result, the inner part of the nonwoven fabric, where the water-soluble resin is less abundant and the ultrafine fibers are not fixed, is pressed preferentially, leading to a higher fiber density in the inner part than that near the surfaces.

The pressing of the nonwoven fabric may be carried out by calendering or compression achieved while removing the solvent during ultrafine fiber development treatment.

Next, step (iv) is described below.

Step (iv) is designed to combine the sheet resulting from step (iii) above with an elastic polymer containing polyurethane as primary component by performing treatment thereof with a solvent to develop ultrafine fibers with an average monofilament diameter of 0.1 μm or more and 7 μm or less and impregnating the sheet with a solution of an elastic polymer containing polyurethane as primary component, followed by solidification, or designed to impregnate the sheet resulting from step (iii) above with a solution of an elastic polymer containing polyurethane as primary component, followed by solidification, to combine the sheet with the elastic polymer containing polyurethane as primary component, and then treat the sheet with a solvent to develop ultrafine fibers with an average monofilament diameter of 0.1 μm or more and 7 μm or less.

The development of ultrafine fibers is carried out by immersing the nonwoven fabric formed of island-in-sea type composite fibers in a solvent to ensure dissolution and removal of the sea component.

In the case where the ultrafine fiber-developing fiber is an island-in-sea type composite fiber and the sea component is polyethylene, polypropylene or polystyrene, an organic solvent such as toluene or trichloroethylene can be used as the solvent to dissolve and remove the sea component. An aqueous alkali solution of sodium hydroxide or the like can be used when the sea component is, for instance, copolymerized polyester or polylactic acid. Hot water can be used when the sea component is water-soluble thermoplastic polyvinyl alcohol-based resin.

To fix an elastic polymer containing polyurethane as primary component to a sheet of nonwoven fabric, the sheet may be impregnated with a solution of the elastic polymer and then subjected to wet coagulation or dry coagulation, either of which may be selected appropriately depending on the type of polyurethane used.

Next, step (v) is described below.

Step (v) is designed to cut the sheet resulting from step (iv) above in half in the thickness direction.

It is important to cut the sheet resulting from step (iv) in half along the through-thickness central line so that a high-strength plane constitutes the reverse surface of each of the halves.

Next, step (vi) is described below.

Step (vi) is designed to nap only the non-cut surface of each half of the sheet resulting from step (v) above.

It is important for the napping to be performed for the surface that is less abundant in fibers and the elastic polymer containing polyurethane as primary component. That is to say, only the non-cut surface of the sheet should be napped. A surface that is less abundant in fibers and the elastic polymer containing polyurethane as primary component can be napped easily to ensure soft-to-the-touch quality. On the other hand, the surface that is higher in fiber density and higher in the density of the elastic polymer containing polyurethane as primary component should not be ground because its strength would decrease.

The napping treatment can be performed by grinding with sandpaper, roll sander, or the like. Treatment with a lubricant such as silicone emulsion may be performed before the napping step. Furthermore, treatment with an antistatic agent before the napping step is preferred because grinding powder generated from grinding the sheet-like article is prevented from being deposited on the sandpaper.

Embodiments of the present invention provide a sheet-like article in which one of the surfaces is low in the fiber density and the density of the elastic polymer containing polyurethane as primary component and accordingly easy to nap to ensure dense, soft-to-the-touch surface quality while the other surface has a highly strong layer that is high in the fiber density and the density of the elastic polymer containing polyurethane as primary component to ensure high sheet strength, thus allowing the sheet to have both good surface quality and practically high strength though being thin.

The sheet-like article according to the present invention can be dyed. An appropriate dye may be selected to meet the properties of the ultrafine fibers in the sheet-like article. For example, a disperse dye may be used for ultrafine fibers of polyester while an acidic dye or alloy dye may be used for ultrafine fibers of polyamide fiber. In the case where the dyeing is carried out with a disperse dye, it is preferable to perform reduction cleaning after dyeing.

It is also preferable to use a dyeing assistant with the aim of improving dyeing uniformity and reproducibility.

Furthermore, the sheet-like article according to the present invention may be treated with a finishing agent such as softening agent, such as silicone, and antistatic agent. Finishing treatment may be performed after dyeing or simultaneously with dyeing in the same bath.

Having both good appearance and high strength, the sheet-like article according to the present invention can be used suitably as material for facing of furniture and chairs, wall material, facing of seats and ceiling of vehicles including automobiles, trains, and aircraft, and interior finishing for highly graceful appearance. It also serves effectively as clothing material for shirts, jackets, bags, belts, wallets, etc., and parts thereof; upper/trim material for various shoes such as casual shoes, sport shoes, men's shoes, and women's shoes; exterior/case material for mobile devices, personal computers, mobile phones, smartphones, etc., and other industrial materials.

EXAMPLES

Evaluation Methods (1) Melt Flow Rate (MFR) of Polymer:

Four to five grams of sample pellets were placed in the cylinder of an electric furnace of an MFR meter, and the amount (g) of the resin extruded in 10 min under a load of 2,160 gf at a temperature of 285° C. was measured using a melt indexer (S101, manufactured by Toyo Seiki Co., Ltd.).

This measuring procedure was carried out 3 times repeatedly, and the average of the measurements was used as the MFR.

(2) Average Monofilament Diameter:

A cross section of a sample of the sheet-like article was photographed by scanning electron microscopy (SEM) and 100 fibers having a circular or near-circular elliptic section were selected randomly, followed by measuring their monofilament diameter and calculating the average of the 100 measurements.

(3) Thickness of Sheet-Like Article:

The thickness was measured at 10 points along a line in the width direction of the sheet-like article using a Peacock thickness gauge and the average was calculated.

(4) The ratio between the fiber density (A') in the layer having a thickness equal to 50% of the total thickness measured from one of the surfaces, i.e. layer (A), and the fiber density (B') in the layer having a thickness equal to 50% of the total thickness measured from the other surface, i.e. layer (B):

A 20 cm×20 cm sample was taken from the resulting sheet-like article, cut in half along the through-thickness central line, immersed in DMF for 8 hours to ensure complete extraction of the elastic polymer containing polyurethane as primary component, dried, and weighed, followed by using the measured mass to calculate the fiber density by the formula given below:

fiber density=mass of sample after polymer extraction (g)/(20 (cm)×20 (cm)×thickness before polymer extraction (cm)).

The calculations of the fiber density (A') in the layer having a thickness equal to 50% of the total thickness measured from one of the surfaces, i.e. layer (A), and the fiber density (B') in the layer having a thickness equal to 50% of the total thickness measured from the other surface, i.e. layer (B), was used to calculate the fiber density ratio by the formula given below. This procedure was performed for 10 points and the average was calculated.

fiber density ratio=fiber density (*A'*) in the layer having a thickness equal to 50% of the total thickness measured from one of the surfaces, i.e. layer (*A*)/fiber density (*B'*) in the layer having a thickness equal to 50% of the total thickness measured from the other surface, i.e. layer (*B*).

(5) The ratio between the density (A") of the elastic polymer containing polyurethane as primary component in the layer having a thickness equal to 50% of the total thickness measured from one of the surfaces, layer (A), and the density (B") of the elastic polymer containing polyurethane as primary component in the layer having a thickness equal to 50% of the total thickness measured from the other surface, layer (B):

A 20 cm×20 cm sample was taken from the resulting sheet-like article, cut in half along the through-thickness central line, and weighed, and then it was immersed in DMF for 8 hours to ensure complete extraction of the elastic polymer containing polyurethane as primary component, dried, and weighed, followed by using the mass measurements to calculate the density of the elastic polymer containing polyurethane as primary component by the formula given below:

density of elastic polymer=(mass of sample before polymer extraction (g)−mass of sample after polymer extraction (g))/(20 (cm)×20 (cm)× thickness before polymer extraction (cm)).

The calculations of the density (A") of the elastic polymer containing polyurethane as primary component in the layer having a thickness equal to 50% of the total thickness measured from one of the surfaces, layer (A), and the density (B") of the elastic polymer containing polyurethane as primary component in the layer having a thickness equal to 50% of the total thickness measured from the other surface, layer (B), were used to calculate the density ratio (b) of the elastic polymer containing polyurethane as primary component by the formula given below. This procedure was performed for 10 points and the average was calculated.

density ratio of elastic polymer containing polyurethane as primary component=elastic polymer density (*A"*) in the layer having a thickness equal to 50% of the total thickness measured from one of the surfaces, layer (*A*)/elastic polymer density (*B"*) in the layer having a thickness equal to 50% of the total thickness measured from the other surface, layer (*B*).

(6) Overall Density of Sheet-Like Article:

A 20 cm×20 cm sample was taken from the resulting sheet-like article and weighed, and the measured mass was used to calculate the overall density of sheet-like article by the formula given below. This procedure was performed for 10 points and the average was calculated.

overall density of sheet-like article=mass of sample (g)/(20 (cm)×20 (cm)×thickness of sample (cm)).

(7) Appearance Quality:

The quality of a sample was rated on a three-stage (○Δx) scale as shown below based on visual inspection and sensory evaluation by a total of 20 raters made up of 10 healthy male adults and 10 healthy female adults. The rating given by the greatest number of raters was taken as the final rating in external appearance quality. A sample that obtained a rating of ○ or Δ was judged as acceptable.

○: Fibers are dispersed suitably and soft to the touch.

Δ: Fibers are not dispersed suitably in some parts, but soft to the touch.

x: Fibers are very poorly dispersed overall, and rough to the touch.

(8) Thickness Recovery Rate of Dyed Sheet-Like Article:

Calculations were made by the formula given below using the thickness of the sheet-like article measured before and after the dyeing step.

thickness recovery rate (%)=(thickness after dyeing (mm)−thickness before dyeing (mm))/thickness before dyeing (mm).

(9) Tensile Strength:

Five measurements were made according to JIS L1913 6.3.1 (2010) using a constant extension rate type tensile tester under the conditions given below, and the average of the measurements was calculated.

specimen width: 2 cm clamp distance: 10 cm tension speed: 10 cm/min

<Abbreviations of Chemical Substances>

PU: polyurethane

PTMG: polytetramethylene glycol with a number average molecular weight of 2,000

PCL: polycaprolactone with a number average molecular weight of 2,000

MDI: 4,4'-diphenyl methane diisocyanate

DMF: N,N-dimethyl formamide

PET: polyethylene terephthalate

PVA: polyvinyl alcohol

EG: ethylene glycol

<Different Types of Polyurethane (PU)>

(1) Organic Solvent Type Polyurethane I (PU-I)

polyisocyanate: MDI polyol: PTMG 70 mass %, PCL 30 mass % chain stretching agent: EG solvent: DMF

Example 1

Raw Stock

Polyethylene terephthalate (PET) with a MFR of 48 adopted as island component and polystyrene with a MFR of 65 adopted as sea component were subjected to melting spinning using an island-in-sea type composite spinneret having 16 islands per hole under the conditions of a spinning temperature of 285° C., island/sea mass ratio of 80/20, discharge rate of 1.2 g/min·hole, and spinning speed of 1,100 m/min. Subsequently, 2.8-fold stretching was performed in a 90° C. oil bath designed for spinning, and crimping was performed using a stuffer box crimper, followed by cutting to a length of 51 mm to provide raw stock of island-in-sea type composite fiber with a monofilament fineness of 3.8 dtex.

(Entangling)

The raw stock thus obtained was subjected to carding and cross-lapping to produce a laminated fiber web, which was then subjected to needle punching at a rate of 3,500 punches/$cm^2$ to provide an entangled fiber sheet (felt) with a thickness of 1.8 mm and a density of 0.25 g/$cm^3$.

(Injection of Water-Soluble Resin, Sea Removal, and Pressing)

The entangled fiber sheet thus obtained was subjected to shrinkage treatment in hot water at a temperature of 96° C., impregnated with an 12 mass % aqueous solution of PVA with a degree of saponification of 88%, squeezed so that the solid content relative to the fiber would reach a target value of 30 mass %, and dried in hot air at a temperature of 140° C. for 10 minutes while promoting the migration of PVA, thereby providing a sheet containing PVA. The sheet containing PVA thus obtained was immersed in trichloroethylene and subjected to 10 repetitions of liquid squeezing and pressing with a mangle to carry out dissolution and removal of the sea component and pressing of the sheet containing PVA, thereby providing a sea-free, PVA-containing sheet that comprises bundles of ultrafine fibers carrying PVA.

(Injection of Elastic Polymer)

The sea-free, PVA-containing sheet thus obtained was impregnated with a DMF solution of polyurethane-I (PU-I) adjusted to a solid content of 12 mass %, and squeezed so that the solid content relative to the fiber would reach a target value of 30 mass %, followed by coagulating the polyurethane in a 30 mass % aqueous solution of DMF. Subsequently, PVA and DMF were removed in hot water and drying was performed in hot air at a temperature of 110° C. for 10 minutes to provide a sheet containing polyurethane.

(Halving and Napping)

The sheet containing polyurethane thus obtained was cut in half in the thickness direction, and only the surface opposite to the cut surface was ground with endless sandpaper with a sandpaper grit number of 240 to produce a napped surface while adjusting the thickness simultaneously, thereby providing a napped sheet with a thickness of 0.45 mm.

(Dyeing)

The napped sheet thus obtained was dyed using a jet dyeing machine at a temperature of 120° C. and dried using a drying machine, thereby providing a leathery sheet (sheet-like article).

The sheet-like article thus obtained was found to be small in the rate of thickness recovery in the dyeing step and also high in both quality and tensile strength. Results are given in Table 1.

Example 2

Raw Stock

PET with a MFR of 48 adopted as island component and polystyrene with a MFR of 65 adopted as sea component were subjected to melting spinning using an island-in-sea type composite spinneret having 36 islands per hole under the conditions of a spinning temperature of 280° C., island/sea mass ratio of 55/45, discharge rate of 1.3 g/min·hole, and spinning speed of 1,300 m/min. Subsequently, 3.6-fold stretching was performed in a 90° C. oil bath designed for spinning, and crimping was performed using a stuffer box crimper, followed by cutting to a length of 51 mm to provide raw stock of island-in-sea type composite fiber with a monofilament fineness of 3.1 dtex.

(Entangling—Dyeing)

A leathery sheet (sheet-like article) was produced according to the same procedure as in Example 1 except for using the aforementioned raw stock.

The sheet-like article thus obtained was found to be small in the rate of thickness recovery in the dyeing step and also high in both quality and tensile strength. Results are given in Table 1.

Example 3

Raw Stock

PET with a MFR of 48 adopted as island component and polystyrene with a MFR of 65 adopted as sea component were subjected to melting spinning using an island-in-sea type composite spinneret having 200 islands per hole under the conditions of a spinning temperature of 280° C., island/sea mass ratio of 50/40, discharge rate of 1.1 g/min·hole, and spinning speed of 1,300 m/min. Subsequently, 3.3-fold stretching was performed in a 90° C. oil bath designed for spinning, and crimping was performed using a stuffer box crimper, followed by cutting to a length of 51 mm to provide raw stock of island-in-sea type composite fiber with a monofilament fineness of 2.8 dtex.

(Entangling—Dyeing)

A leathery sheet (sheet-like article) was produced by carrying out the same procedure as in Example 1 except for using the aforementioned raw stock.

The sheet-like article thus obtained was found to be small in the rate of thickness recovery in the dyeing step and also high in both quality and tensile strength. Results are given in Table 1.

Example 4

Raw Stock

The same raw stock as in Example 1 was used.

(Entangling)

The raw stock thus obtained was subjected to carding and cross-lapping to produce a laminated fiber web, which was then subjected to needle punching at a rate of 2,700 punches/$cm^2$ to provide an entangled fiber sheet (felt) with a thickness of 1.9 mm and a density of 0.20 g/$cm^3$.

(Injection of Water-Soluble Resin)

A leathery sheet (sheet-like article) was produced by carrying out the same procedure as in Example 1 except that the sheet was squeezed to a target of 55 mass % in the PVA injection step.

The sheet-like article thus obtained was found to be small in the rate of thickness recovery in the dyeing step and also high in both quality and tensile strength. Results are given in Table 1.

Comparative Example 1

Raw Stock

The same raw stock as in Example 1 was used.

(Entangling—Dyeing)

A leathery sheet (sheet-like article) was produced by carrying out the same procedure as in Example 1 except that both the cut surface and the opposite surface thereto were ground while adjusting the thickness to 0.45 mm in the napping step.

As a result of grinding the cut surface where both the fiber density and the polyurethane density were high, the sheet-like article obtained was large in the rate of thickness recovery in the dyeing step and small in tensile strength although high in both the fiber density ratio and the elastic polymer density ratio and also high in quality. Results are given in Table 1.

Comparative Example 2

Raw Stock

The same raw stock as in Example 1 was used.

(Entangling—Dyeing)

A leathery sheet (sheet-like article) was produced by carrying out the same procedure as in Example 1 except that injection of PVA was not performed and that both the cut surface and the opposite surface thereto were ground while adjusting the thickness to 0.45 mm in the napping step.

As a result of omitting the PVA injection step and accordingly increasing the overall density in the cross-sectional direction of the sheet-like article, the sheet-like article obtained was large in the rate of thickness recovery in the dyeing step and low in quality although high in both the fiber density ratio and the elastic polymer density ratio and also high in tensile strength. Results are given in Table 1.

Comparative Example 3

Raw Stock

The same raw stock as in Example 1 was used.

(Entangling—Dyeing)

A leathery sheet (sheet-like article) was produced by carrying out the same procedure as in Example 1 except that only the cut surface was ground while adjusting the thickness to 0.45 mm in the napping step.

As a result of only the cut surface where the fiber density and the polyurethane density were high being ground in the napping and thickness adjustment step, the sheet-like article obtained was high in both the fiber density ratio and the elastic polymer density ratio, low in tensile strength, large in the rate of thickness recovery in the dyeing step, and low in quality. Results are given in Table 1.

Comparative Example 4

Raw Stock

The same raw stock as in Example 1 was used.

(Entangling—Dyeing)

A leathery sheet (sheet-like article) was produced by carrying out the same procedure as in Example 1 except that PVA injection was carried out by drying the sheet in hot air at a temperature 100° C. for 30 minutes while depressing the migration of PVA and immersing the PVA-containing sheet in trichloroethylene to remove the sea component.

As a result of an increase in the fiber density and the polyurethane density near the product-side surface, the sheet-like article obtained was high in both the fiber density ratio and the elastic polymer density ratio, low in tensile strength, large in the rate of thickness recovery in the dyeing step, and low in quality. Results are given in Table 1.

TABLE 1

| | Diameter of ultrafine fiber (μm) | Type of PU | Quantity of PVA added (mass %) | Surface state: one surface (product side) | Surface state: other surface (reverse side) | Ratio of fiber density between layer (A) and layer (B) (A'/B') | Ratio of elastic polymer density between layer (A) and layer (B) (A''/B'') |
|---|---|---|---|---|---|---|---|
| Example 1 | 5 | PU-I | 30 | napped | nap-free | 0.8 | 0.9 |
| Example 2 | 2 | PU-I | 30 | napped | nap-free | 0.6 | 0.7 |
| Example 3 | 0.7 | PU-I | 30 | napped | nap-free | 0.9 | 0.9 |
| Example 4 | 5 | PU-I | 55 | napped | nap-free | 0.5 | 0.6 |
| Comparative example 1 | 5 | PU-I | 30 | napped | napped | 1.2 | 1.3 |
| Comparative example 2 | 5 | PU-I | 30 | napped | napped | 1.1 | 1.2 |
| Comparative example 3 | 5 | PU-I | 30 | nap-free | napped | 1.4 | □5 |
| Comparative example 4 | 5 | PU-I | 30 | napped | nap-free | 1.1 | 1.2 |

TABLE 1-continued

| | Overall density of sheet-like article ($g/cm^3$) | Thickness of sheet-like article (mm) | Thickness recovery during dyeing (%) | Appearance quality | Tensile strength (N/cm) Vertical | Tensile strength (N/cm) Horizontal |
|---|---|---|---|---|---|---|
| Example 1 | 0.30 | 0.56 | 24 | ○ | 42 | 27 |
| Example 2 | 0.35 | 0.54 | 20 | ○ | 55 | 33 |
| Example 3 | 0.39 | 0.53 | 18 | ○ | 59 | 38 |
| Example 4 | 0.28 | 0.57 | 27 | ○ | 38 | 24 |
| Comparative example 1 | 0.25 | 0.63 | 40 | ○ | 27 | 17 |
| Comparative example 2 | 0.41 | 0.62 | 38 | x | 60 | 41 |
| Comparative example 3 | 0.21 | 0.65 | 44 | x | 15 | 9 |
| Comparative example 4 | 0.31 | 0.60 | 33 | x | 29 | 20 |

The invention claimed is:

1. A sheet-like article comprising ultrafine fibers with an average monofilament diameter of 0.1 μm or more and 7 μm or less and an elastic polymer containing polyurethane as primary component, meeting Formula (a) given below for the ratio between the fiber density (A') in a layer having a thickness equal to 50% of the total thickness measured from one surface of the sheet-like article, herein referred to as layer (A), and the fiber density (B') in a layer having a thickness equal to 50% of the total thickness measured from the opposite surface of the sheet-like article, herein referred to as layer (B), meeting Formula (b) given below for the ratio between the density (A") of the elastic polymer containing polyurethane as primary component in layer (A) and the density (B") of the elastic polymer containing polyurethane as primary component in layer (B), and having an overall density of 0.2 $g/cm^3$ or more and 0.6 $g/cm^3$ or less for the entire sheet-like article:

$$1>(A')/(B')\geq 0.5 \quad \text{(a)}$$

$$1>(A'')/(B'')\geq 0.6 \quad \text{(b).}$$

2. A sheet-like article as claimed in claim 1, wherein one of the surfaces contains raised ultrafine fibers while the other surface contains ultrafine fibers and an elastic polymer containing polyurethane as primary component, with the ultrafine fibers in the latter surface being held by the elastic polymer.

3. A sheet-like article as claimed in claim 1 that has a thickness of 0.2 mm or more and 0.8 mm or less.

4. A production method for a sheet-like article as claimed in claim 1, comprising ultrafine fibers with an average monofilament diameter of 0.1 pm or more and 7 pm or less and an elastic polymer containing polyurethane as primary component, that comprises the following steps of (i) to (vi) to be carried out in this order:

(i) a step for preparing nonwoven fabric by entangling ultrafine fiber-generating fibers comprising two or more types of thermoplastic resin that differ in solubility to a solvent, (ii) a step for impregnating the nonwoven fabric with an aqueous solution of water-soluble resin and drying it at 110° C. or more to combine it with the water-soluble resin, (iii) a step for pressing the nonwoven fabric combined with water-soluble resin to provide a sheet, (iv) a step for combining the sheet resulting from step (iii) above with an elastic polymer containing polyurethane as primary component by performing treatment thereof with a solvent to develop ultrafine fibers with an average monofilament diameter of 0.1 pm or more and 7 pm or less and impregnating the sheet with a solution of an elastic polymer containing polyurethane as primary component, followed by solidification, or impregnating the sheet resulting from step (iii) above with a solution of an elastic polymer containing polyurethane as primary component, followed by solidification, to combine the sheet with the elastic polymer containing polyurethane as primary component, and then treating the sheet with a solvent to develop ultrafine fibers with an average monofilament diameter of 0.1 pm or more and 7 pm or less, (v) cutting the sheet resulting from step (iv) above in half in the thickness direction, and (vi) napping only the non-cut surface of each half of the sheet resulting from step (v) above.

* * * * *